US010143867B2

(12) United States Patent
Su et al.

(10) Patent No.: US 10,143,867 B2
(45) Date of Patent: Dec. 4, 2018

(54) DUAL-SUSPENSIBLE ANTI-FALLING DEVICE

(71) Applicant: Aerohook Technology Co., Ltd., Taichung (TW)

(72) Inventors: Mao-Kai Su, Taichung (TW); Yi-Ching Lin, Taichung (TW)

(73) Assignee: Aerohook Technology Co., Ltd., Taichung (TW)

( * ) Notice: Subject to any disclaimer, the term of this patent is extended or adjusted under 35 U.S.C. 154(b) by 0 days.

(21) Appl. No.: 15/364,201

(22) Filed: Nov. 29, 2016

(65) Prior Publication Data

US 2018/0147425 A1 May 31, 2018

(51) Int. Cl.
*A62B 35/00* (2006.01)

(52) U.S. Cl.
CPC ..... *A62B 35/0093* (2013.01); *A62B 35/0075* (2013.01)

(58) Field of Classification Search
CPC ..... A62B 35/005; A62B 35/0068; A62B 1/10; A62B 35/0093; A62B 35/0075
See application file for complete search history.

(56) References Cited

U.S. PATENT DOCUMENTS 5,722,612 A * 3/1998 Feathers ..... A62B 35/0093 192/103 C
7,870,934 B2 * 1/2011 Ecker ..... A62B 35/0093 182/234
8,181,744 B2 * 5/2012 Parker ..... A62B 1/10 182/232
9,121,462 B2 * 9/2015 Casebolt ..... A62B 1/10
2005/0051659 A1 * 3/2005 Wolner ..... A62B 1/10 242/383.5
2010/0226748 A1 * 9/2010 Wolner ..... A62B 35/0093 414/815

FOREIGN PATENT DOCUMENTS

EP 1034814 A1 * 9/2000 ..... A62B 35/0093
GB 2543366 A * 4/2017 ..... A62B 1/08

* cited by examiner

*Primary Examiner* — Alvin C Chin-Shue
(74) *Attorney, Agent, or Firm* — Raymond Y. Chan; David and Raymond Patent Firm

(57) ABSTRACT

The present invention is composed with a frame, a rotary drum, a rotor, and a turbination spring. The frame comprising a left upright board, a right upright board, and an upper bridging portion arranged on top of the left upright board and right upright board to define a chamber with front and back opening. The upper bridging portion comprises a first lifting lug coupled thereon. The frame comprises a second lifting lug arranged at a proper position thereof. The left upright board has a breaking frame having a foramen. An axis is arranged across the chamber at the center of the foramen. The axis is couple with a rotary drum that comprises a rescue cord circled therearound. The rotor is arranged on the left end of the rotary drum and comprises a bias component that is adapted to the foramen. The turbination spring is arranged between the right end of the rotary drum and the right upright board, so as to keep the rotary drum restoring to the axis. It mainly utilizes the overall arrangement of the first and second lifting lugs and the frame to satisfy the requirements of a dual-suspension anti-falling device and make it economically efficient and lighter.

1 Claim, 9 Drawing Sheets

DUAL-SUSPENSIBLE ANTI-FALLING DEVICE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to the field of dual-suspensible or dual-anchorable anti-falling device. It helps to enhance the security of the suspension or anchoring of the anti-falling device.

Description of Related Arts

Anti-falling devices are necessary in protect the personnel security in various anti-falling circumstances, such as rock climbing, mountaineering, construction, marine operation, oil production, mining, etc.

Generally speaking, the anti-falling circumstances usually provide a retaining ring at high place with railing, beam-column, screw anchor, etc. as a first anchoring spot for an anti-falling device to hang thereon. However, the first anchoring spots are often exposed to the outdoor environment for a long time, so it can be damaged due to, for example being rusted, easily after weathering. As a result, when it is provided for the anti-falling device to hang or anchor, there is risk of overload and dropping.

Hence, there was conventional anti-falling device as FIG. 1 shows. It mainly has a first lifting lug 91 arranged on the top of the fully-covered shell 90 and a second lifting lug 92 arranged on a side of the shell 90. When implementing the anti-falling device, the anti-falling setting has to provide not only a retaining ring 93 at a first anchoring spot, but a supplementary ring 94 at a second anchoring spot of a proper position. Then the first lifting lug 91 is anchored at the retaining ring 93 with a buckle 95, while a supplementary cable 96 is linked between the supplementary ring 94 and the second lifting lug 92. Therefore, the supplementary cable 96, the supplementary ring 94, and the second lifting lug 92 can make a second anti-dropping safety arrangement, so as to eliminate the dropping risk of only relying on the first lifting lug 91 to hang or anchor at the retaining ring 93.

Nevertheless, the shell 90 of the anti-falling device showed in FIG. 1 is made of high intensity metal in order to provide sufficient supports for dealing with the stresses of the first lifting lug 91 and the second lifting lug 92. Besides, the shell 90 is fully-covered, and, therefore, has larger size. As a result, the metal shell 90 has the drawbacks of not only overweight and poor portability, but also higher material cost.

Because the above issues, the present inventor has been carefully doing research and development, so as to eventually come out with the present invention to be improved in the disadvantages of the conventional connecting devices.

SUMMARY OF THE PRESENT INVENTION

The present invention provides a dual-suspensible anti-falling device, comprising:

a frame comprising a left upright board, a right upright board, and an upper bridging portion arranged on top of the left upright board and right upright board to define a chamber with front and back opening, wherein the left upright board has a breaking frame having a foramen, wherein the left upright board and the right upright board comprise an axis arranged thereacross at the center of the foramen;

a hanging arrangement, comprising a first lifting lug coupled with the upper bridging portion and a second lifting lug arranged on the frame;

a rotary drum, limited in the chamber, comprising a rescue cord circled thereon, and concentrically coupled with the axis, such that the front edge and back edge energy of the rotary drum respectively protrude from the front and back of the chamber;

a rotor, fixed on the left end of the rotary drum and comprising a bias component adapted for the foramen arranged thereon; and a turbination spring, arranged between the right end of the rotary drum and the right upright board, to drive the rotary drum to autorotatably restore around the axis.

Therefore, the present invention utilizes a first lifting lug and a second lifting lug arranged on a frame for dual-suspension. More importantly, the chamber with front and back opening arranges the rotary drum, rotor, and turbination spring in a half-covered manner, so as to improve on the drawbacks, such as high cost, overweight, poor portability, etc. of the conventional anti-falling device showed in FIG. 1.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
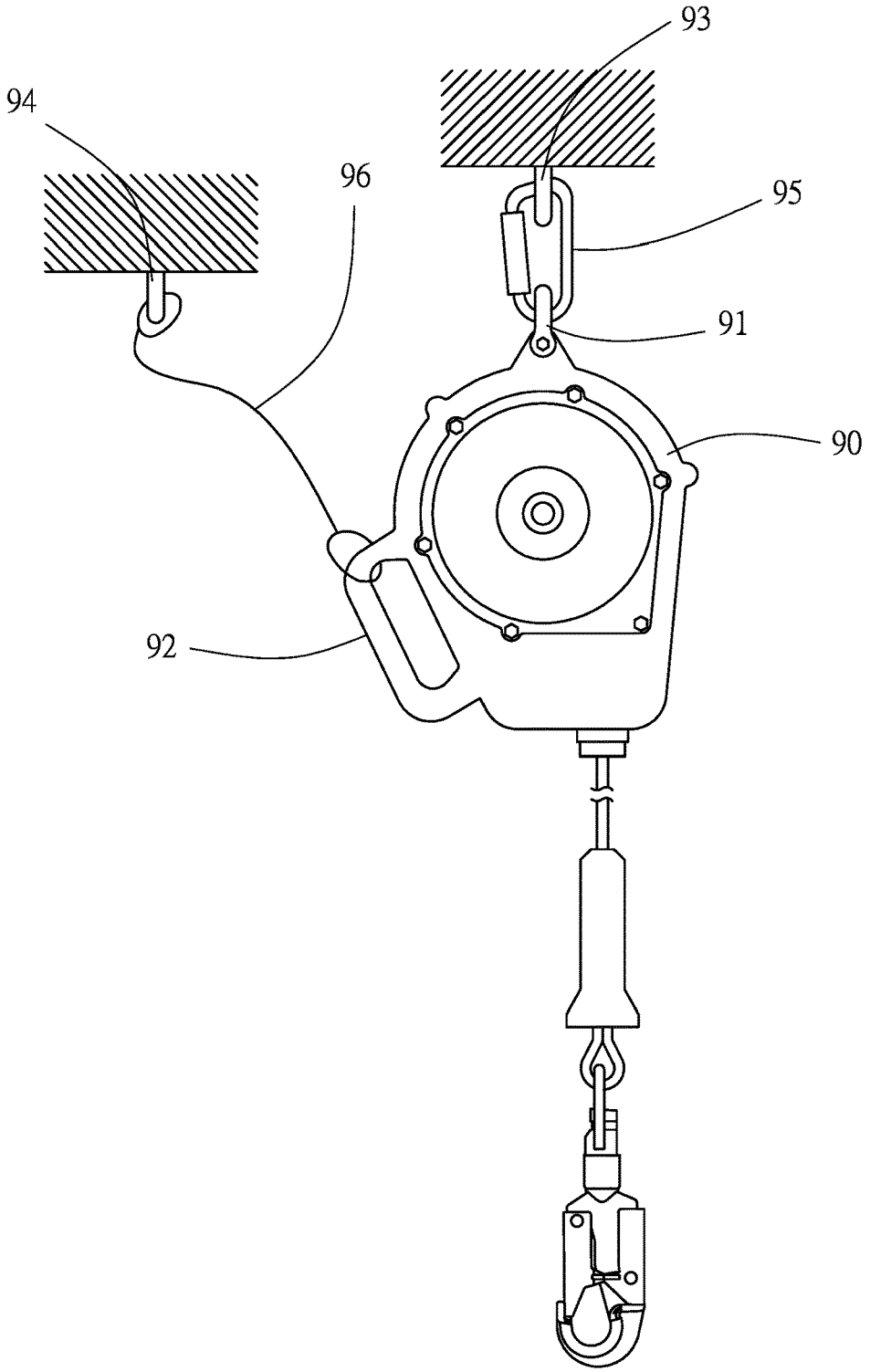
PRIOR ART FIG.1
FIG. 1 is a perspective view of the implementation of a dual-suspension anti-falling device according to prior art.
Figure 2:
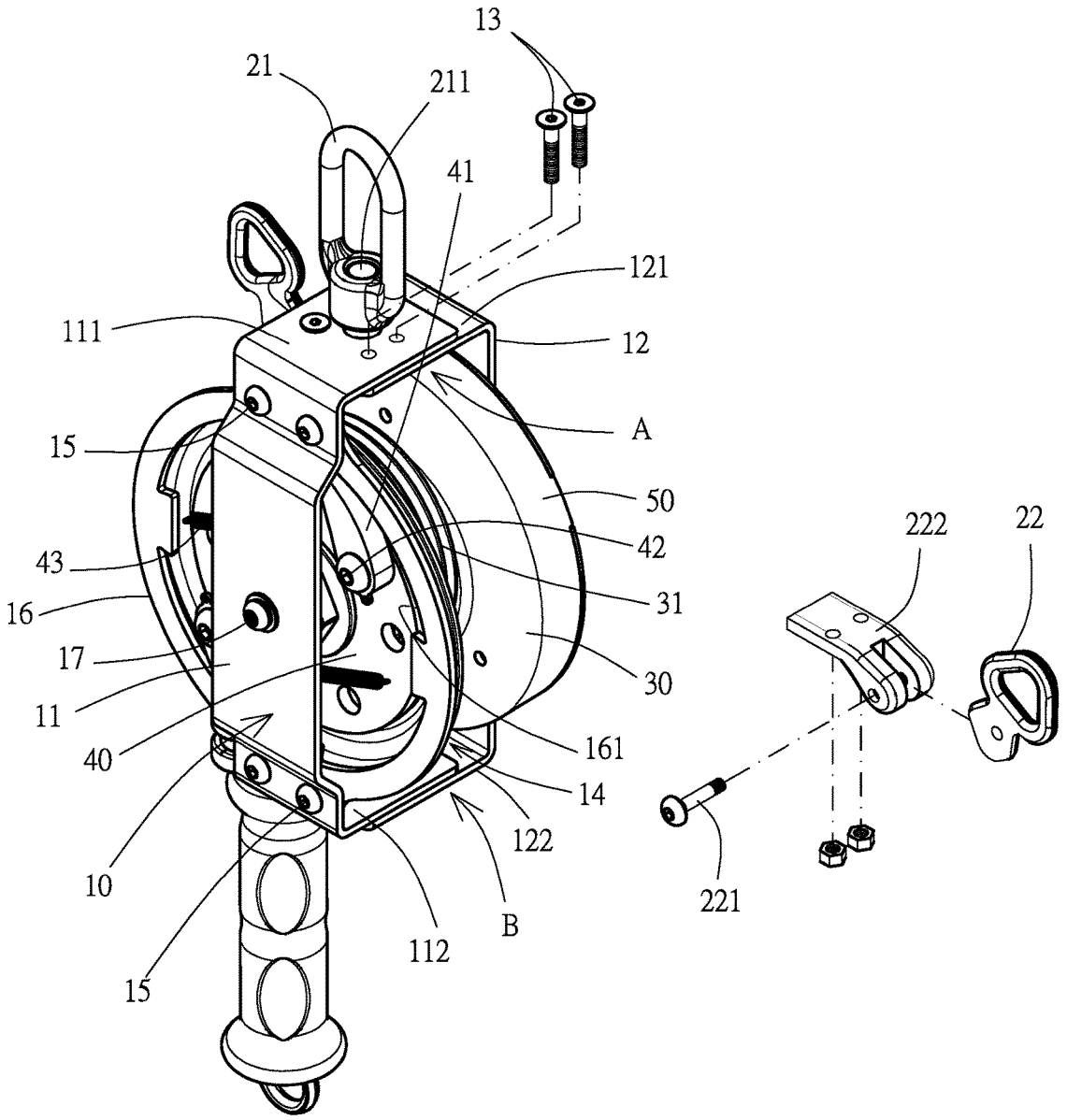
FIG. 2 is a partial explosive view of the present invention.
Figure 3:
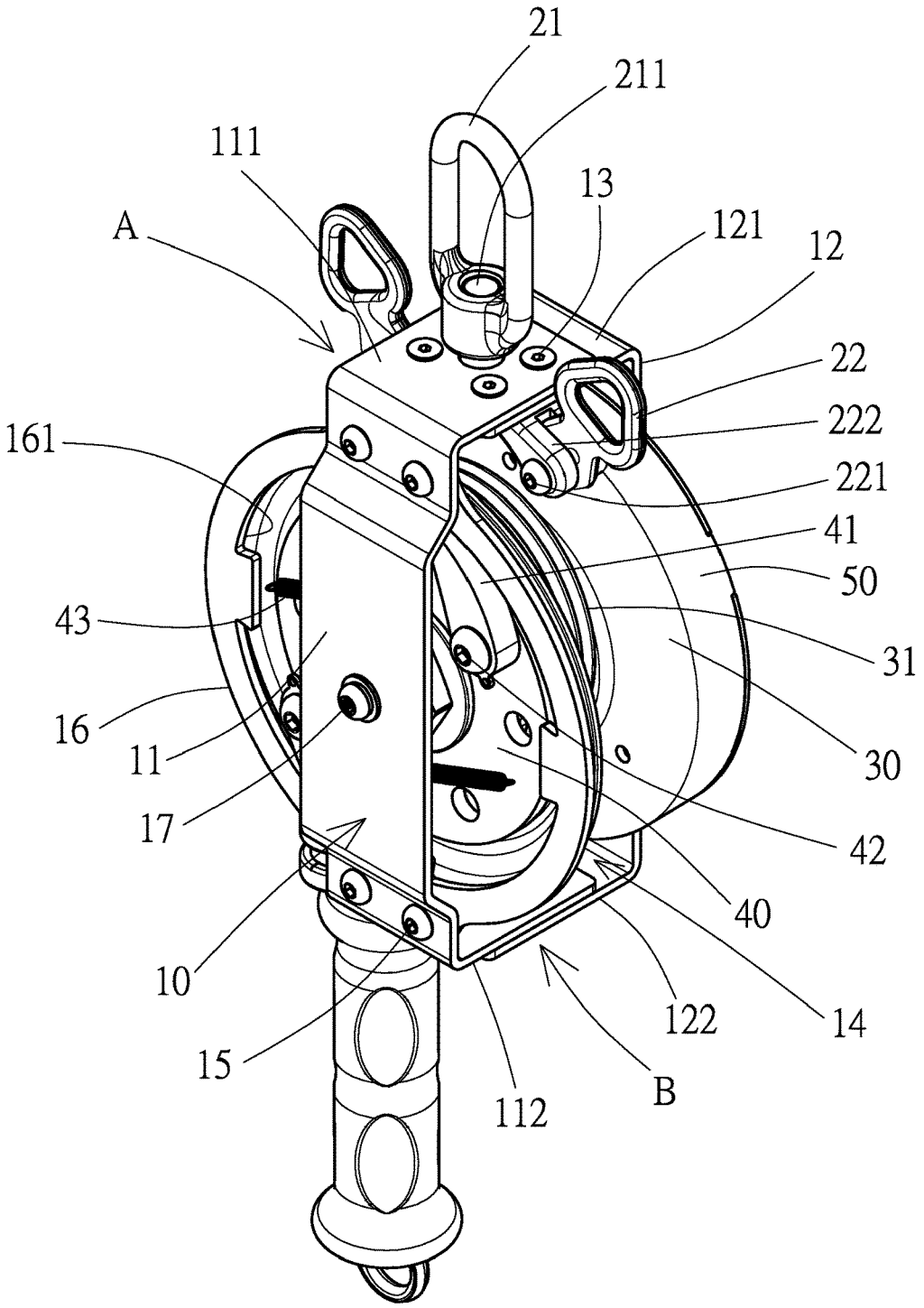
FIG. 3 is a perspective view of the assembling of FIG. 2.
Figure 4:
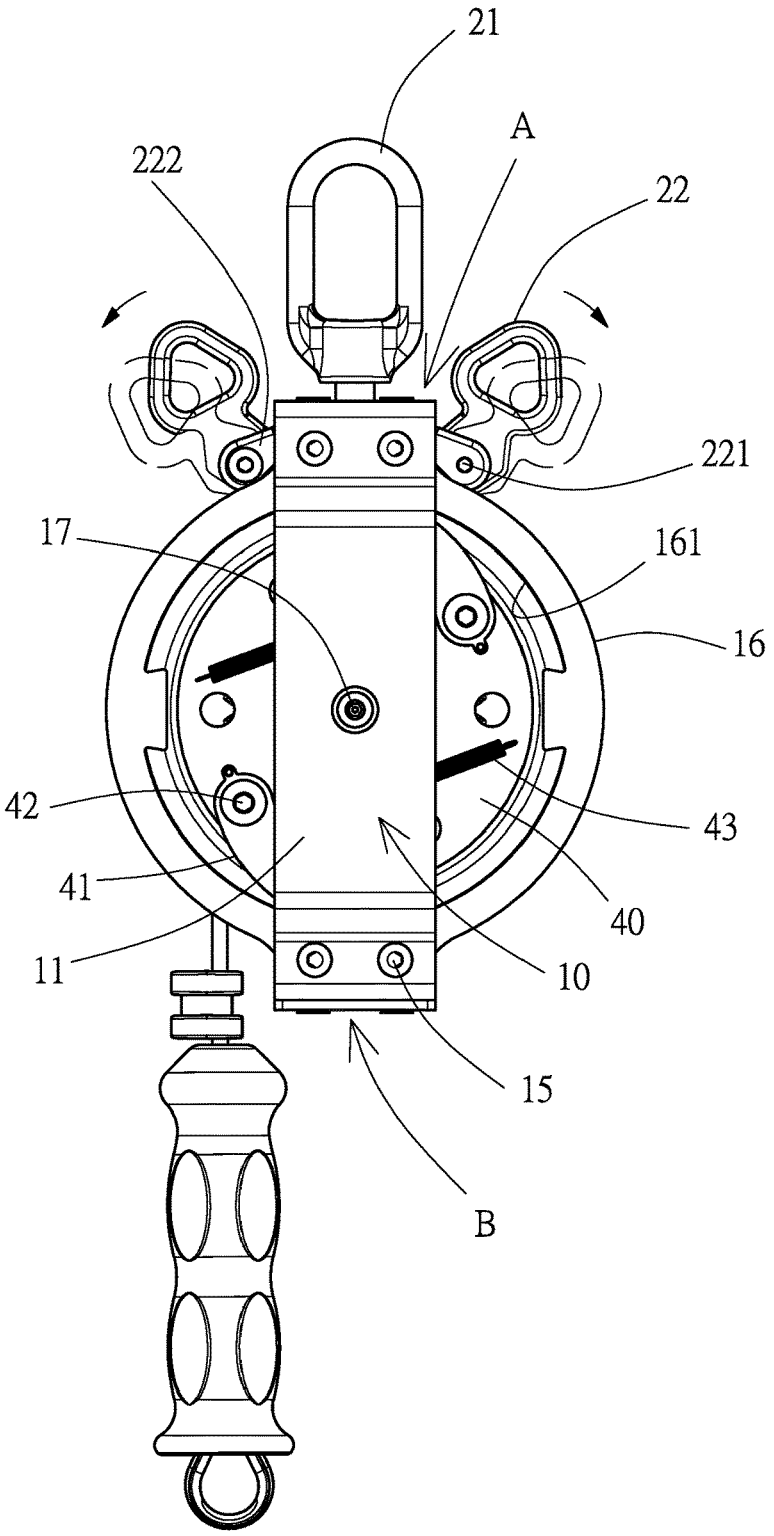
FIG. 4 is a perspective view of biasing of the second lifting lug according to the present invention.

Referring to FIGS. 1-4, the present invention is composed of a frame 10, a hanging arrangement, a rotary drum 30, a rotor 40, and a turbination spring 50. The overall arrangement of the frame 10, the rotary drum 30, the rotor 40, and the turbination spring 50 is similar with the prior arts of Taiwan Pat. No. 103223016 and U.S. Pat. No. 9,121,462B2, which is an application of prior art rather than the present invention. Therefore, the detail structures of the rotary drum 30, the rotor 40, and the turbination spring 50 will not be repeated herein. Here, the present invention comprises:

a frame 10, having a left upright board 11 and a right upright board 12 opposite to each other, wherein the top of the left upright board 11 comprises an upper lateral board 111 extended thereon and the bottom of the left upright board 12 comprises a lower lateral board 112 extended thereon opposite to the upper lateral board 111, wherein the top of the right upright board 11 comprises an upper hood 121 extended thereon and overlappingly connected with the upper lateral board 111 and the bottom of the right upright board 12 comprises a lower hood 122 extended thereon and overlappingly connected with the lower lateral board 112, wherein the upper lateral board 111 and the upper hood 121 are integrally locked by a first screw 13 so as to form an upper bridging portion A of the left upright board 11 and the right upright board 12, while the lower lateral board 112 and the lower hood 122 are integrally locked by a second screw (not shown in the drawings) so as to form a lower bridging portion B, such that the frame 10 defines a chamber with front and back opening, wherein the left upright board 11 comprises a breaking frame 16 having a foramen 161 locked on the inner side thereof with a third screw 15, wherein the left upright board 11 and the right upright board 12 comprise an axis 17 arranged thereacross at the center of the foramen 161;

a hanging arrangement, comprising a first lifting lug arranged at the center of the upper bridging portion A, wherein the first lifting lug 21 utilizes a vertical shaft 211 to be coupled above the upper bridging portion A, so as to allow the first lifting lug 21 to autorotate around the vertical shaft 211, wherein both the front edge and back edge of the upper bridging portion A comprise a protruding second lifting lug 22 respectively, wherein the second lifting lugs 22 are coupled on a base 222 by means of a lateral axis 221, wherein the base 222 is locked on the upper bridging portion A with the first screw 13, as FIG. 4 illustrated, such that the second lifting lugs 22 are allowed to swing within a predetermined angle to the front and rear of the frame 10 around the lateral axis 221.

a rotary drum 30, limited in the chamber 14, comprising a rescue cord 31 circled thereon, and concentrically coupled with the axis 17, such that the front edge and back edge of the rotary drum 30 respectively and correspondingly protrude from the front and back of the chamber 14;

a rotor 40, fixed on the left end of the rotary drum 30, comprising a bias component 41 arranged within the scope of the foramen 161, wherein an end of the bias component 41 is pivotally arranged on the rotor 40 with an eccentric axis 42, wherein another end of the bias component 41 and the rotor 40 comprise a spring 43 arranged therebetween, such that the act of the spring 43 on the another end of the bias component 42 provides a back drawing tendency for positioning at any time and when the user walks at height normally or falls, the rotary drum 30 and rotor 40 can rotate around the axis 17 to responds to the quick stretching of the rescue line, and provide a centrifugal force to the bias component 41 so that the another end of the bias component 41 can overcome the force of the spring 43 and swing outward to be buckled into the foramen 161, which makes the rotary drum 30 and the rotor 40 stuck by the breaking frame 16 of the frame 10 and unable to turn, so as to achieve the effect of anti-falling security; and a turbination spring 50, arranged between the right end of the rotary drum 30 and the right upright board 12, to keep the rotary drum 30 restoring to the axis 17.

When implementing the present invention, the anti-falling setting has to provide not only a first anchoring spot, but a second anchoring spot. Then it can be arranged as FIG. 4 illustrated that the first lifting lug 21 is anchored at the first anchoring spot and the second lifting lug 22 is connected to the second anchoring spot with a supplementary cable, such that the second lifting lug 22 can become a second anti-dropping safety arrangement for the anti-falling device. Even if the first lifting lug 21 fails, the second lifting lug 22 can still keep the anti-falling device suspended. Besides, the second lifting lug 22 allows the anti-falling device to naturally swing around the lateral axis 221 within a certain angle during the suspension, so as to improve on the issues of interference and stress concentration during the operation thereof.

Therefore, the present invention utilizes a first lifting lug 21 and a second lifting lug 22 arranged on a frame 10 to achieve dual-suspension, which can greatly increase the operational safety of the anti-falling device. Besides, the chamber 14 with front and back opening defined by the frame 10 arranges the rotary drum 30, rotor 40, and turbination spring 50 thereon in a half-covered manner, so as to improve on the drawbacks, such as high cost, overweight, poor portability etc. of conventional anti-falling device showed in FIG. 1.

Figure 5:
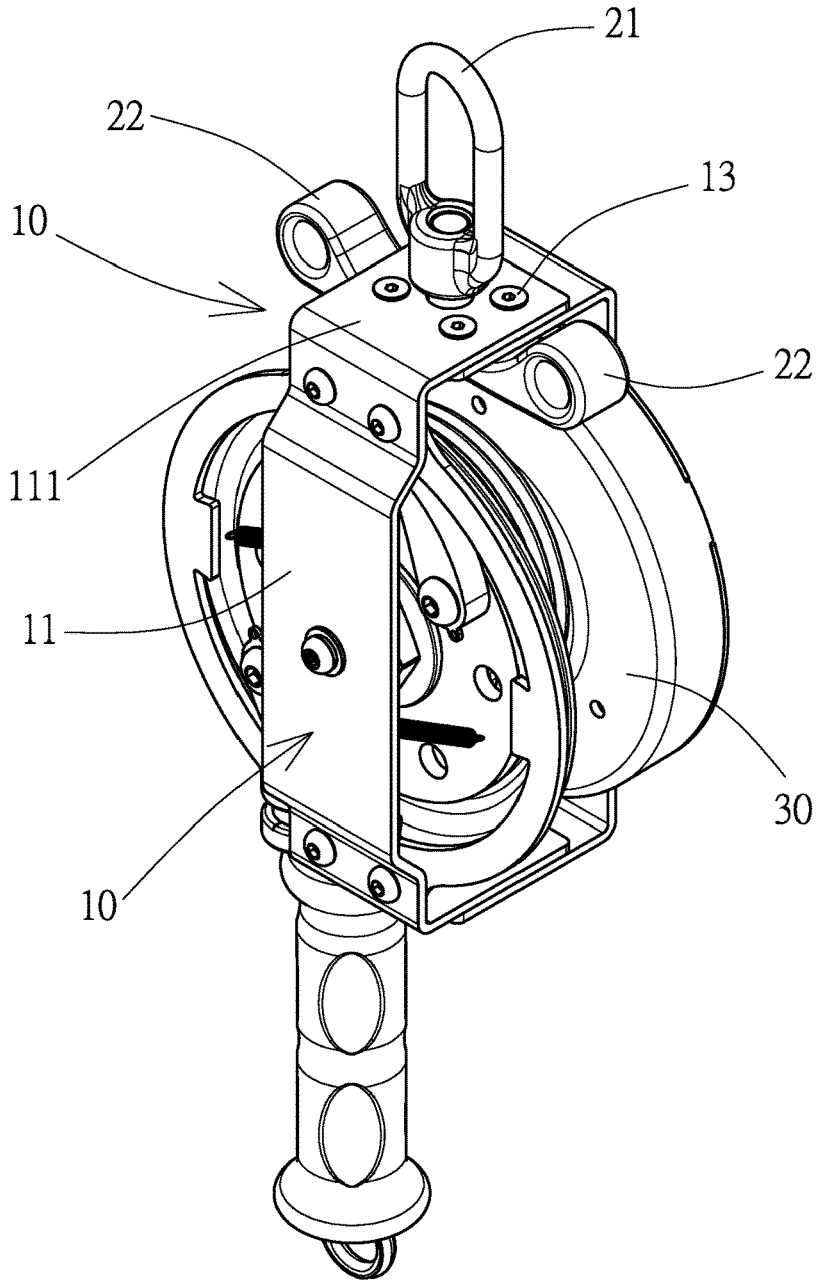
FIG. 5 is a perspective view of the second lifting lug according to a second embodiment of the present invention.
Figure 6:
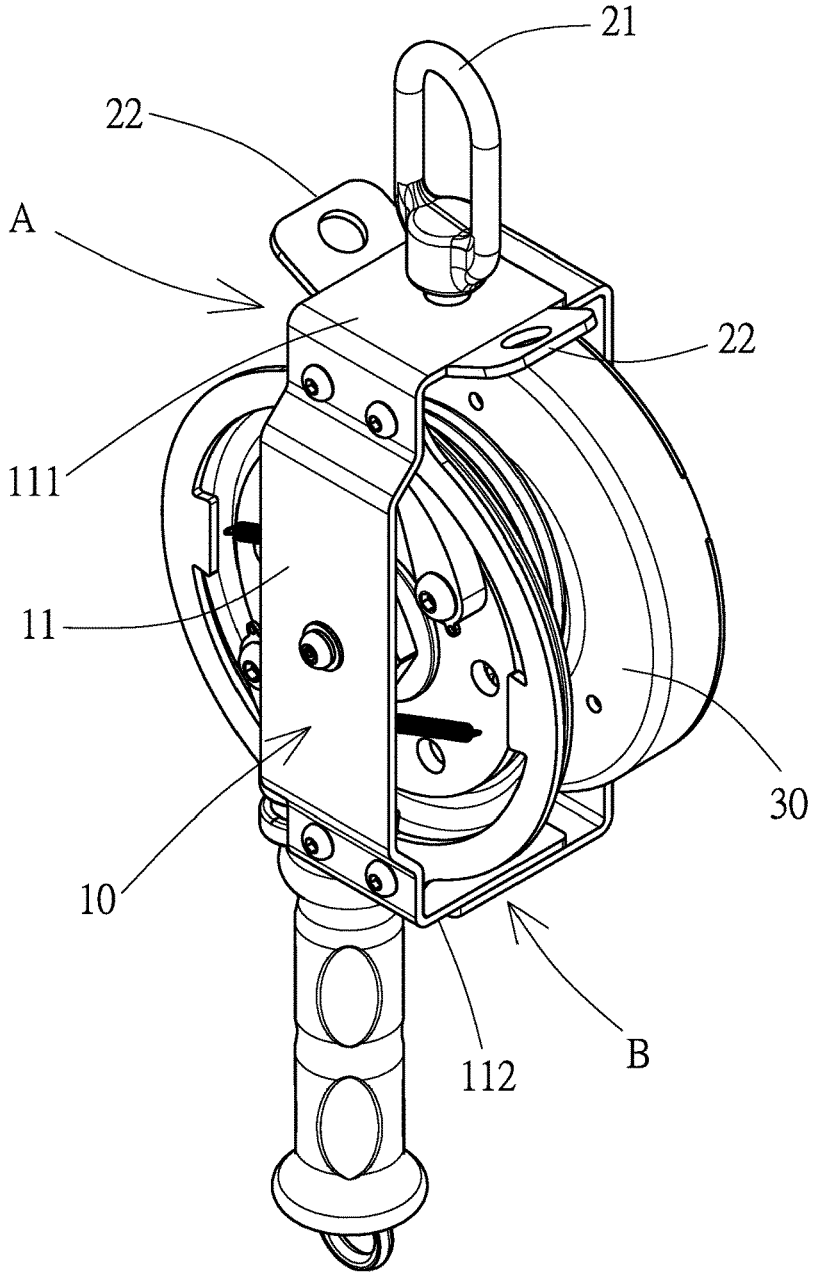
FIG. 6 is a perspective view of the second lifting lug according to a third embodiment of the present invention.

Referring to FIG. 5, the present invention was further illustrated that the second lifting lug 22 is directly locked on the front and rear of the upper bridging portion A with the first screw 13. Alternatively, it is, as FIG. 6 illustrated, integrally extended from the front and rear of the upper lateral board 111. Preferably, the second lifting lug 22 will gradually outwardly and upwardly extends, such that supplementary cable linked on the second lifting lug 22 will not interfere the rotary drum 30 much.

Figure 7:
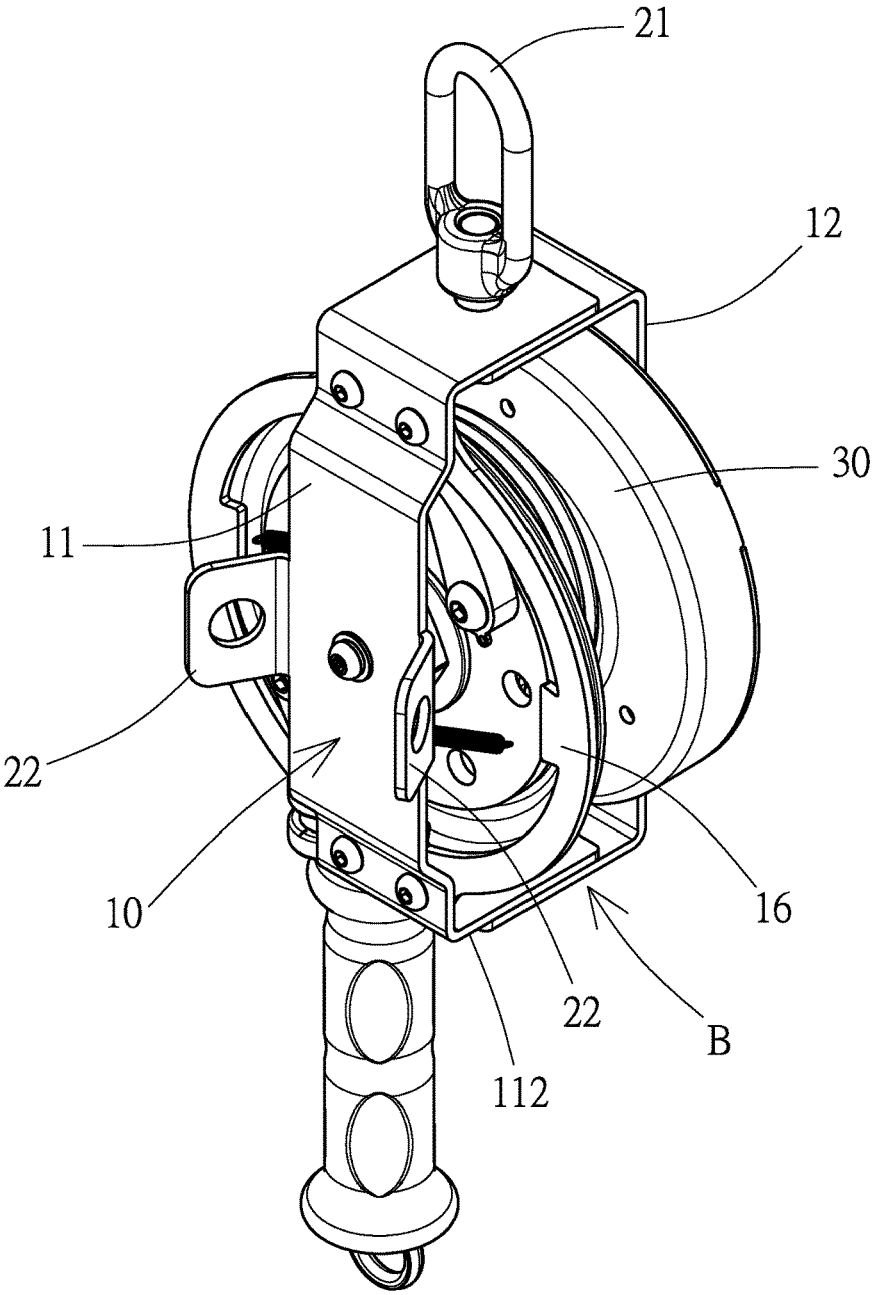
FIG. 7 is a perspective view of the second lifting lug according to a fourth embodiment of the present invention.
Figure 8:
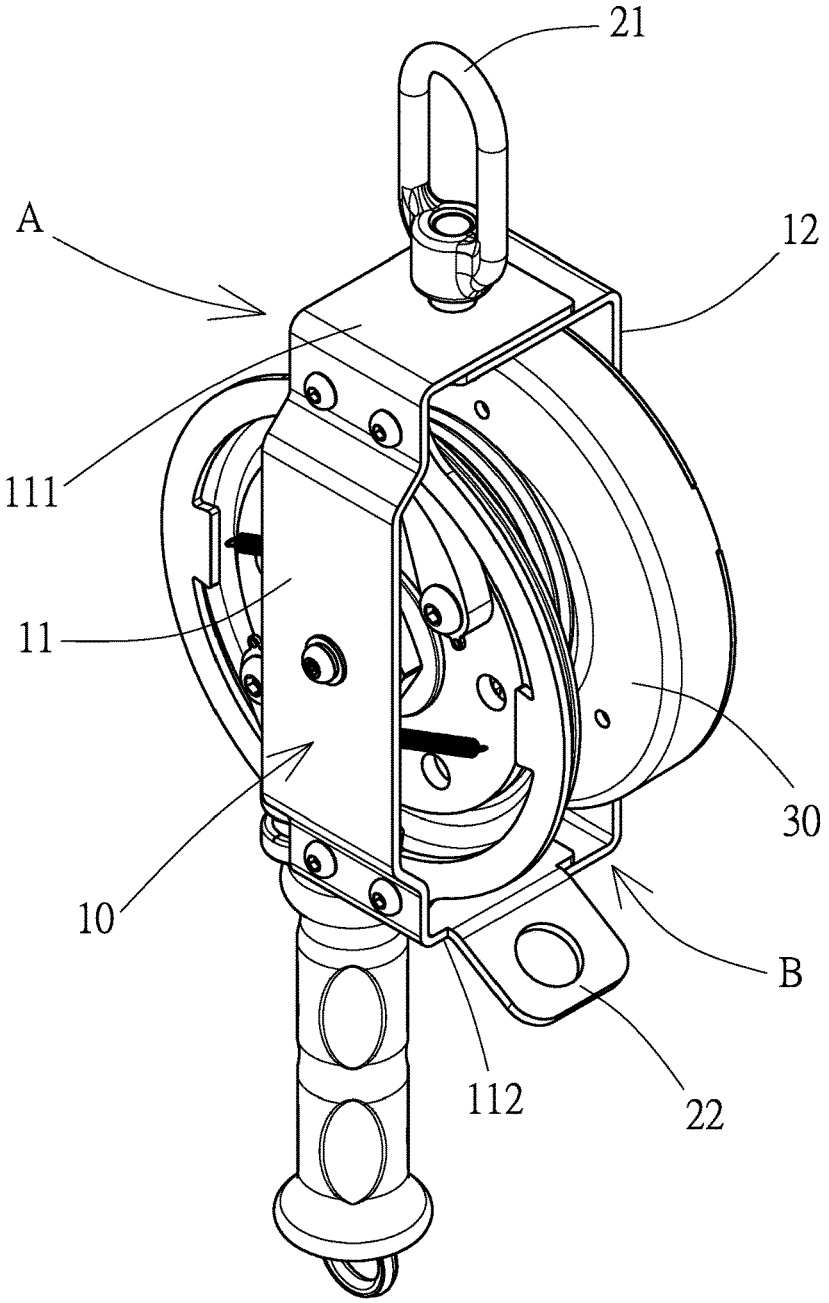
FIG. 8 is a perspective view of the second lifting lug according to a fifth embodiment of the present invention.

Referring to FIG. 7, the present invention was further illustrated that the second lifting lug 22 is directly integrally extended from the front and rear of the left upright board 11. Preferably, the second lifting lug is arranged to gradually tilt outwards, so that the supplementary cable linked on the second lifting lug 22 will not interfere the breaking frame 16 much. Referring to FIG. 8, similarly, the second lifting lug 22 can also be integrally extended from the front and rear of the lower lateral board 112. Then, the second lifting lug 22 is gradually outwardly and upwardly extended, such that supplementary cable linked on the second lifting lug 22 will not interfere the rotary drum 30 much.

Figure 9:
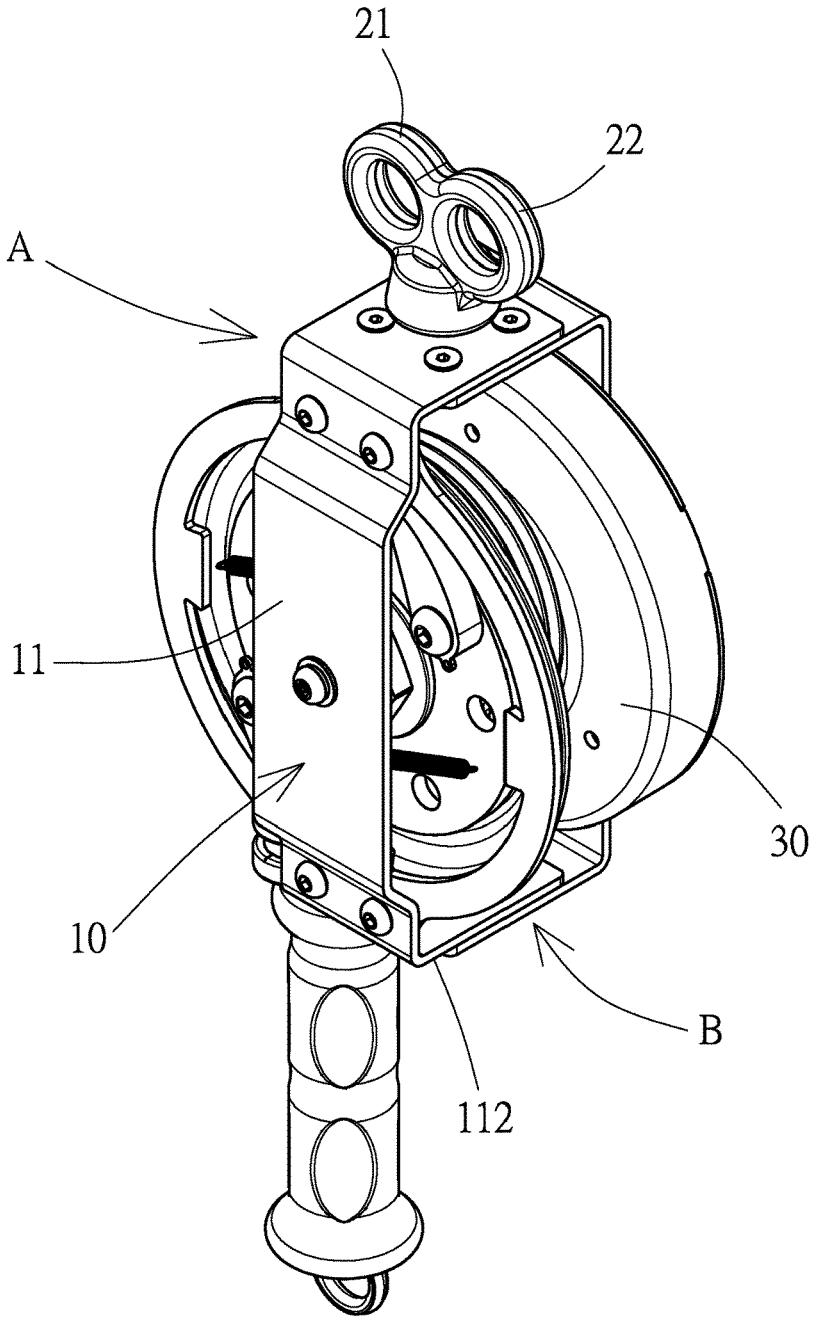
FIG. 9 is a perspective view of the second lifting lug according to a sixth embodiment of the present invention.

Referring to FIG. 9, the present invention is further illustrated that the second lifting lug 22 can also be directly arranged alongside the first lifting lug 21 on the upper bridging portion A. In other words, the present invention comprises an reverse U shaped or square frame with front and back opening or through hole frame 10 which has both a first lifting lug 21 and a second lifting lug 22 arranged thereon.

All in all, the overall structural characteristic of the present invention can be unprecedented in all current structures, which is also an excellent and outstanding design that similar invention or publish have both never been found in the same category. Therefore, the present invention meets the application requirements of patent of an invention, and is lawfully submitted to apply for the patent accordingly. However, the above descriptions are only a preferred embodiment of the present invention, but not to be used to confine the scope of embodying the present invention, which means all equivalent varieties and modifications based on the appended claims of the present invention are within the scope of the present invention.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A dual-suspensible anti-falling device, comprising:

a frame, comprising a left upright board, a right upright boar, and an upper bridging portion arranged on top of said left upright board and said right upright board to define a chamber with front and back openings, wherein said left upright board comprising a breaking frame having a foramen, wherein an axis is arranged at a center of said foramen and across said left upright board and said right upright board, wherein an upper lateral board is extended on a top of said left upright board and a lower lateral board, opposite to said upper lateral board, is extended on a bottom of said left upright board, wherein an upper hood is extended on a top of said right upright board and overlappingly connected with said upper lateral board, and a lower hood is extended on a bottom of said right upright board and overlappingly connected with said lower lateral board, wherein said upper lateral board and said upper hood are integrally locked by a first screw so as to form said upper bridging portion of said left upright board and said right upright board, wherein said lower lateral board and said lower hood are integrally locked by a second screw to form a lower bridging portion of said left upright board and said right upright board;

a hanging arrangement, comprising a first lifting lug coupled with said upper bridging portion, wherein said first lifting lug is arranged at a center of said upper bridging portion, wherein said first lifting lug utilizes a vertical shaft to be coupled above said upper bridging portion, wherein said upper bridging portion has a front edge and a back edge and each of said front edge and said back edge comprises a protruding second lifting lug, wherein a base is locked on said upper bridging portion with a second screw and each of said protruding second lifting lugs is coupled on said base with a lateral axis, such that each of said protruding second lifting lugs is allowed to swing within a predetermined angle to a front and a rear of said frame around said lateral axis;

a rotary drum, having a left end and a right end, being limited in said chamber and concentric with said axis, wherein a rescue cord being circled on said rotary drum, such that a front edge and a back edge of said rotary drum are protruded from a front and a back of said chamber respectively;

a rotor, fixed on said left end of said rotary drum, comprising a bias component, wherein said foramen is arranged on said bias component; and a turbination spring, arranged between said right end of said rotary drum and said right upright board.

* * * * *